US006467886B1

(12) United States Patent
Takao et al.

(10) Patent No.: US 6,467,886 B1
(45) Date of Patent: Oct. 22, 2002

(54) INK-JET HEAD, METHOD FOR FABRICATING SAME, AND INK-JET RECORDING DEVICE

(75) Inventors: Shigeyuki Takao, Fukuoka; Osamu Watanabe; Kenji Tomita, both of Kumamoto; Hiroyuki Matsuo, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/831,934

(22) PCT Filed: Sep. 13, 2000

(86) PCT No.: PCT/JP00/06290

§ 371 (c)(1),
(2), (4) Date: May 15, 2001

(87) PCT Pub. No.: WO01/19614

PCT Pub. Date: Sep. 13, 2000

(30) Foreign Application Priority Data

Sep. 16, 1999 (JP) ..... 11-261800

(51) Int. Cl.[7] ..... B41J 2/045
(52) U.S. Cl. ..... 347/68
(58) Field of Search ..... 347/55, 54, 68, 347/69, 70, 71, 72; 29/25.35; 310/328, 311, 330, 331

(56) References Cited

U.S. PATENT DOCUMENTS 5,512,793 A * 4/1996 Takeuchi et al. ..... 310/328
5,790,156 A * 8/1998 Mutton et al. ..... 347/71

FOREIGN PATENT DOCUMENTS

| | | |
|---|---|---|
| JP | 2-274557 | 11/1990 |
| JP | 10-181015 | 8/1998 |
| JP | 10-264384 | 10/1998 |

* cited by examiner

*Primary Examiner*—Anh T. N. Vo
(74) *Attorney, Agent, or Firm*—Harness, Dickey & Pierce, P.L.C.

(57) ABSTRACT

An ink jet head H is downsized by making piezoelectric elements 23, top electrodes 24 provided on surfaces of the piezoelectric elements 23 that are opposite to pressure rooms 3, and bottom electrode 22 provided on other surfaces of the piezoelectric elements 23 that are on the pressure rooms 3 into thin films in piezoelectric actuators 21, a crack covering layer 28 made from an electric insulating material is arranged on the surfaces of the piezoelectric elements 23 that are on the bottom electrode 22 so that the electric insulating material is filled into the cracks 23*b* in the piezoelectric elements 23, in order to prevent the piezoelectric actuators 21 from malfunctioning due to the cracks 22*b*, 23*b* occurring during the film formation of the bottom electrode 22 and piezoelectric elements 23.

16 Claims, 6 Drawing Sheets

INK-JET HEAD, METHOD FOR FABRICATING SAME, AND INK-JET RECORDING DEVICE

TECHNICAL FIELD

The present invention belongs to a technical field involving an ink jet head which utilizes piezoelectric actuators to discharge ink through its nozzles, a method for fabricating the ink jet head, and an ink jet recording device.

BACKGROUND ART

An ink jet head which utilizes piezoelectric actuators to discharge ink is a known art, and may comprise a head main body 101 including a plurality of hollows 102 as pressure rooms each having an inlet 102*a* for ink supply and an outlet 102*b* for ink discharge as shown in FIG. 9. The hollows 102 are arranged at regular intervals in one direction (perpendicular to the paper) in the head main body 101.

The head main body 101 is composed of a pressure room component 105 forming the side walls of the hollows 102, an ink path component 106 which forms the bottom wall of the hollows 102 and is made by bonding a plurality of thin plates together, and a nozzle plate 113. The ink path component 106 includes paths 107 for ink supply and paths 108 for ink discharge, which are connected with the inlets 102*a* and outlets 102*b*, respectively. The paths 107 for ink supply are connected to an ink supply room 110 extending in the direction in which the hollows 102 are arranged, and the ink supply room 110 is connected to an ink supply hole 111, which is formed in the pressure room component 105 and ink path component 106, and is connected with an ink tank outside the drawing. The nozzle plate 113 is provided with nozzles 114 connected with the paths 108 for ink discharge.

On the top surface of the pressure room component 105 of the head main body 101, piezoelectric actuators. 121 are provided in such a manner as to block the hollows 102 of the head main body 101, thereby making up pressure rooms 103 with the hollows 102. The piezoelectric actuators 121 include piezoelectric elements 123 and top electrodes 124 provided on the surfaces of the piezoelectric elements 123 that are opposite to the pressure rooms 103 side. In addition, a bottom electrode 122 is provided on the surfaces of the piezoelectric elements 123 that are on the pressure rooms 103 side. The single bottom electrode 122 is shared by all the piezoelectric actuators 121, and also functions as a so-called diaphragm.

Applying a pulse-like voltage between the bottom electrode 122 and the top electrodes 124 causes the piezoelectric elements 123 to contract in the direction perpendicular to the direction of their thickness due to electric fields developing inside the piezoelectric elements 123. On the other hand, the bottom electrode 122 and top electrodes 124 do not contract, so that a so-called bimetal effect makes the portions of the piezoelectric actuators 121 that correspond to the pressure rooms 103 deform to bend toward the pressure rooms 3 side. This deformation generates pressure inside the pressure rooms 3, and makes the pressure discharge the ink in the pressure rooms 3 outside through the nozzles 114 via the outlets 102*b* and paths 108 for ink discharge.

By the way, such ink jet heads that utilize piezoelectric actuators to discharge ink through the nozzles have been variously improved in recent years to meet the stringent demands for reduction in size, driving voltage, noise, cost, improvement in ink discharge control, and the like. In order to achieve further downsizing and higher performance, it is possible to form the piezoelectric elements and electrodes into thin films, which can be micromachined easily. The easiest and most reliable method for forming these thin films is first to form the top electrodes, piezoelectric elements, and bottom electrode in this order on a substrate by spattering or deposition, then to fix the bottom electrode thus formed to the head main body, and later to eliminate the substrate by etching or another process.

However, the spattering or deposition undesirably develops foreign particles during the film formation, which cause minute defective portions in indefinite regions in the piezoelectric elements in such a manner as to be isolated by cracks from the other parts. Above all, in the case of spattering, unevenness in discharge or potential in the initial stages of the spattering can trigger to cause more such defective portions. The defective portions gradually grow as the film formation proceeds, making the cracks be extended and tapered down in the thickness direction of the piezoelectric elements. These cracks usually have approximately circular openings on both surfaces of the piezoelectric elements in their thickness direction (penetrating the piezoelectric elements in their thickness direction). Moreover, forming the bottom electrode onto the piezoelectric elements by spattering or deposition makes the bottom electrode have defective portions, which are caused by and contiguous with the defective portions in the piezoelectric elements. As a result, the bottom electrode has cracks contiguous with the cracks in the piezoelectric elements. The bottom electrode further has similar defective portions, which are caused in regions not contiguous with the defective portions of the piezoelectric elements. When the bottom electrode is made from chrome preferably used for its excellent ink discharge performance and other characteristics in order to function the electrode as a diaphragm, defective portions occur much more easily. Although the occurrence of these defective portions can be restricted to some extent, it is difficult to eliminate them completely.

The presence of the defective portions (cracks) in the piezoelectric elements decreases their mechanical strength, and increases the intensity of the electric fields in the cracks, thereby promoting leaks. The presence of cracks in the bottom electrode decreases its mechanical strength, and makes it impossible to uniformly apply a voltage on the entire piezoelectric elements. Moreover, if the ink in the pressure rooms happens to be in contact with the piezoelectric elements via the cracks in the bottom electrode, the piezoelectric elements may be melted or damaged in other ways, depending on the material of the ink. If cracks are formed contiguously across the piezoelectric elements and bottom electrode, intrusion by ink having less electric insulation than the piezoelectric elements may cause a short between the bottom and top electrodes, so as to produce a dielectric breakdown.

The present invention has been contrived in view of these aspects, and its object is that when an ink jet head is downsized by forming the piezoelectric elements and electrodes of the piezoelectric actuators into thin films, the piezoelectric actuators are prevented from malfunctioning due to the cracks developing in the piezoelectric elements or electrodes during the film formation, so as to increase their durability.

DISCLOSURE OF THE INVENTION

In order to achieve the above-mentioned object, according to the present invention, the piezoelectric actuators, which include piezoelectric elements, first electrodes provided on the surfaces of the piezoelectric elements that are opposite to the pressure rooms side, and a second electrode provided on the other surfaces of the piezoelectric elements that are on the pressure rooms side, further comprise either a crack covering member or an ink contact prevention member either on the surface of the second electrode that is on the pressure rooms side or on the surfaces of the piezoelectric elements that are on the second electrode side. The crack covering member is made from an electric insulating material, which is used to fill a crack, whereas the ink contact prevention member prevents the ink in the pressure rooms from being in contact with the piezoelectric elements via the crack in the second electrode.

To be more specific, the first invention relates to an ink jet head comprising: a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet, wherein a crack covering member made from an electric insulating material is arranged on a surface of the piezoelectric element of said piezoelectric actuator that is on the second electrode side in such a manner as to fill said electric insulating material into a crack which is open on the surface of the piezoelectric element that is on the second electrode side.

In the above structure, filling the electric insulating material into the crack in the piezoelectric element not only maintains the mechanical strength of the piezoelectric element but also prevents leaks in the crack. As a result, even if forming the piezoelectric element and other components by spattering or deposition causes a crack in the piezoelectric element, the crack does not cause the piezoelectric actuator to malfunction, so that excellent ink discharge performance can be maintained for a long period of time.

According to the second invention, in the ink jet head of the first invention, said crack covering member is formed as a layer on the surface of the piezoelectric element that is on the second electrode side.

This structure makes it possible, when there are a plurality of cracks, to fill the electric insulting material into all cracks at once while forming the layer on the surface of the piezoelectric element that is on the second electrode side, making it unnecessary to provide every one of the cracks with the crack covering member. Furthermore, even if the ink in the pressure room intrudes into the crack in the second electrode, the piezoelectric element is blocked against the ink by the layer. -In addition, since the ink never intrudes into the crack in the piezoelectric element, there is no occurrence of a short between the first and second electrodes even if the ink has lower electric insulation than the piezoelectric element. Although the crack covering member in the form of a layer may lower the electric field generated on the piezoelectric element, a predetermined electric field can be generated by making the layer thin enough.

The third invention relates to an ink jet head comprising: a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet, wherein a crack covering member made from an electric insulating material is provided on a surface of the second electrode of said piezoelectric actuator that is on the pressure room side in such a manner as to fill said electric insulating material into a crack which is open on the surface of the second electrode that is on the pressure room side and which is contiguous across the second electrode and piezoelectric element.

In this structure, filling the electric insulating material into a crack, which is contiguous across the second electrode and piezoelectric element, not only maintains the mechanical strength of the second electrode and piezoelectric element but also prevents leaks in the crack in the piezoelectric element. In addition, there is no intrusion by ink into the crack contiguous across the second electrode and piezoelectric element, thereby protecting the piezoelectric element against intrusion by the ink. As a result, similar to the first invention, the durability of the piezoelectric actuators can be increased.

According to the fourth invention, in the ink jet head of the third invention, said crack covering member is formed as a layer on the surface of the second electrode that is on the pressure room side.

This structure facilitates the filling of the electric insulating material into every crack. Furthermore, even if the second electrode has an additional crack in a region not contiguous with the crack in the piezoelectric element, the ink is prevented from intruding into the additional crack, thereby securing the protection of the piezoelectric element against intrusion of the ink.

The fifth invention relates to an ink jet head comprising: a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet, wherein an ink contact prevention member is formed as a layer on the surface of the piezoelectric element of said piezoelectric actuator that is on the second electrode side so as to prevent the piezoelectric element from being in contact with the ink inside the pressure room via a crack penetrating the second electrode in a thickness direction thereof.

This structure can protect the piezoelectric element against intrusion by the ink, thereby increasing the durability of the piezoelectric actuator. If there is no occurrence of a crack in the portion of the piezoelectric element that is between the first and second electrodes, an approximately uniform electric field can be generated on the entire piezoelectric element by making the ink contact prevention layer from a conductive material.

The sixth invention relates to an ink jet head comprising: a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet, wherein an ink contact prevention member is formed on the surface of the second electrode of said piezoelectric actuator that is on the pressure room side so as to prevent the piezoelectric element from being in contact with the ink inside the pressure room via a crack penetrating the second electrode in a thickness direction thereof.

This structure can protect the piezoelectric element against intrusion of the ink, thereby increasing the durability of the piezoelectric actuator.

According to the seventh invention, in the ink jet head of the sixth invention, said ink contact prevention member is formed as a layer on the surface of the second electrode that is on the pressure room side.

This structure eliminates the necessity of providing the ink contact prevention member to each of the plural cracks, which facilitates the protection of the piezoelectric element against intrusion of the ink. If there is no occurrence of a crack in the portion of the piezoelectric element that is between the first and second electrodes, an approximately uniform electric field can be generated on the entire piezoelectric element by making the ink contact prevention member formed as a layer from a conductive material and filling the conductive material into the crack in the second electrode.

The eighth invention relates to a method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and second electrode, said method comprising the steps of: forming the first electrode on a substrate; forming the piezoelectric element on the first electrode; forming a crack covering layer made from an electric insulating material on the piezoelectric element while filling said electric insulating material into a crack which is open on a top surface of the piezoelectric element; forming the second electrode on said crack covering layer; fixing the second electrode to a pressure room forming member having a space for the pressure room; and removing the substrate after said fixing step.

This structure easily realizes the ink jet head of the second invention.

The ninth invention relates to a method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and second electrode, said method comprising the steps of: forming the first electrode on a substrate; forming the piezoelectric element on the first electrode; forming the second electrode on the piezoelectric element; forming a crack covering layer made from an electric insulating material on the second electrode, while filling said electric insulating material into a crack which is open on a top surface of the second electrode and which is contiguous across the second electrode and piezoelectric element; fixing said crack covering layer to a pressure room forming member having a space for the pressure room; and removing the substrate after said fixing step.

This structure easily realizes the ink jet head of the fourth invention.

The tenth invention relates to a method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and second electrode, said method comprising the steps of: forming the first electrode on a substrate; forming the piezoelectric element on the first electrode; forming an ink contact prevention layer on the piezoelectric element; forming the second electrode on. said ink contact prevention layer; fixing the second electrode to a pressure room forming member having a space for the pressure room; and removing the substrate after said fixing step, wherein said ink contact prevention layer prevents the ink contained in the pressure room from being in contact with the piezoelectric element via a crack penetrating the second electrode in a thickness direction thereof.

This structure easily realizes the ink jet head of the fifth invention.

The eleventh invention relates to a method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and second electrode, said method comprising the steps of: forming the first electrode on a substrate; forming the piezoelectric element on the first electrode; forming the second electrode on the piezoelectric element; forming an ink contact prevention layer on the second electrode; fixing said ink contact prevention layer to a pressure room forming member having a space for the pressure room; and removing the substrate after said fixing step, wherein said ink contact prevention layer prevents the ink contained in the pressure room from being in contact with the piezoelectric element via a crack penetrating the second electrode in a thickness direction thereof.

This structure easily realizes the ink jet head of the seventh invention.

The twelfth invention relates to a method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and second electrode, said method comprising the steps of: forming the first electrode on a substrate; forming the piezoelectric element on the first electrode; forming a crack covering layer made from an electric insulating material on the piezoelectric element, while filling said electric insulating material into a crack occurring in the piezoelectric element in such a manner as to be open on a top surface of the piezoelectric element; forming the second electrode on the piezoelectric element; forming an ink contact prevention layer on the second electrode; fixing said ink contact prevention layer to a pressure room forming member having a space for the pressure room; and removing the substrate after said fixing step, wherein said ink contact prevention layer prevents the ink contained in the pressure room from being in contact with the piezoelectric element via a crack penetrating the second electrode in a thickness direction thereof.

This structure provides the crack covering layer on the surface of the piezoelectric element that is on the second electrode side, and the ink contact prevention layer on the surface of the second electrode that is on the pressure room side. As a result, even if cracks occur in both the piezoelectric element and second electrode, it is secured to prevent the cracks from causing the piezoelectric actuator to malfunction, thereby increasing its durability.

The thirteenth invention relates to an ink jet recording device comprising: an ink jet head composed of a head main body including a hollow as a pressure room having an inlet for ink supply and an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet; and relative transfer means for transferring said ink jet head and a recording medium relatively, wherein recording is performed by directing jets of ink at the recording medium through the nozzle of the head main body of said ink jet head, while said ink jet head is being transferred relatively to the recording medium by said relative transfer means.

Said ink jet recording device further comprises a crack covering member made from an electric insulating material and arranged on a surface of the piezoelectric element of said piezoelectric actuator of said ink jet head that is on the second electrode side in such a manner as to fill said electric insulating material into a crack which is open on the surface of the piezoelectric element that is on the second electrode side.

This invention offers the same effects as the first invention.

The fourteenth invention relates to an ink jet recording device comprising: an ink jet head composed of a head main body including a hollow as a pressure room having an inlet for ink supply and an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet; and relative transfer means for transferring said ink jet head and a recording medium relatively, wherein recording is performed by directing jets of ink at the recording medium through the nozzle of the head main body of said ink jet head, while said ink jet head is being transferred relatively to the recording medium by said relative transfer means.

Said ink jet recording device further comprises a crack covering member made from an electric insulating material and arranged on a surface of the second electrode of said piezoelectric actuator of said ink jet head that is on the pressure room side in such a manner as to fill said electric insulating material into a crack which is open on the surface of the second electrode that is on the pressure room side and which is contiguous across the second electrode and piezoelectric element.

This invention offers the same effects as the third invention.

The fifteenth invention relates to an ink jet recording device comprising: an ink jet head composed of a head main body including a hollow as a pressure room having an inlet for ink supply and an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet; and relative transfer means for transferring said ink jet head and a recording medium relatively, wherein recording is performed by directing jets of ink at the recording medium through the nozzle of the head main body of said ink jet head, while said ink jet head is being transferred relatively to the recording medium by said relative transfer means.

Said ink jet recording device further comprises a crack covering member made from an electric insulating material and arranged as a layer on a surface of the piezoelectric element of said piezoelectric actuator of said ink jet head that is on the second electrode side so as to prevent the ink contained in the pressure room from being in contact with the piezoelectric element, via a crack penetrating the second electrode in a thickness direction thereof.

This structure offers the same effects as the fifth invention.

The sixteenth invention relates to an ink jet recording device comprising: an ink jet head composed of a head main body including a hollow as a pressure room having an inlet for ink supply and an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to the pressure room side, and a second electrode arranged on other surface of the piezoelectric element that is on the pressure room side, said piezoelectric actuator making the pressure room deform to decrease its capacity by applying a voltage onto the piezoelectric element via the first electrode and second electrode, thereby discharging ink contained inside the pressure room through the outlet; and relative transfer means for transferring said ink jet head and a recording medium relatively, wherein recording is performed by directing jets of ink at the recording medium through the nozzle of the head main body of said ink jet head, while said ink jet head is being transferred relatively to the recording medium by said relative transfer means.

Said ink jet recording device further comprises an ink contact prevention member arranged on a surface of the second electrode of said piezoelectric actuator of said ink jet head that is on the pressure room side so as to prevent the ink contained in the pressure room from being in contact with the piezoelectric element via a crack penetrating the second electrode in a thickness direction thereof.

This structure offers the same effects as the sixth invention.

BEST MODE FOR CARRYING OUT THE INVENTION

Embodiment 1

Figure 1:
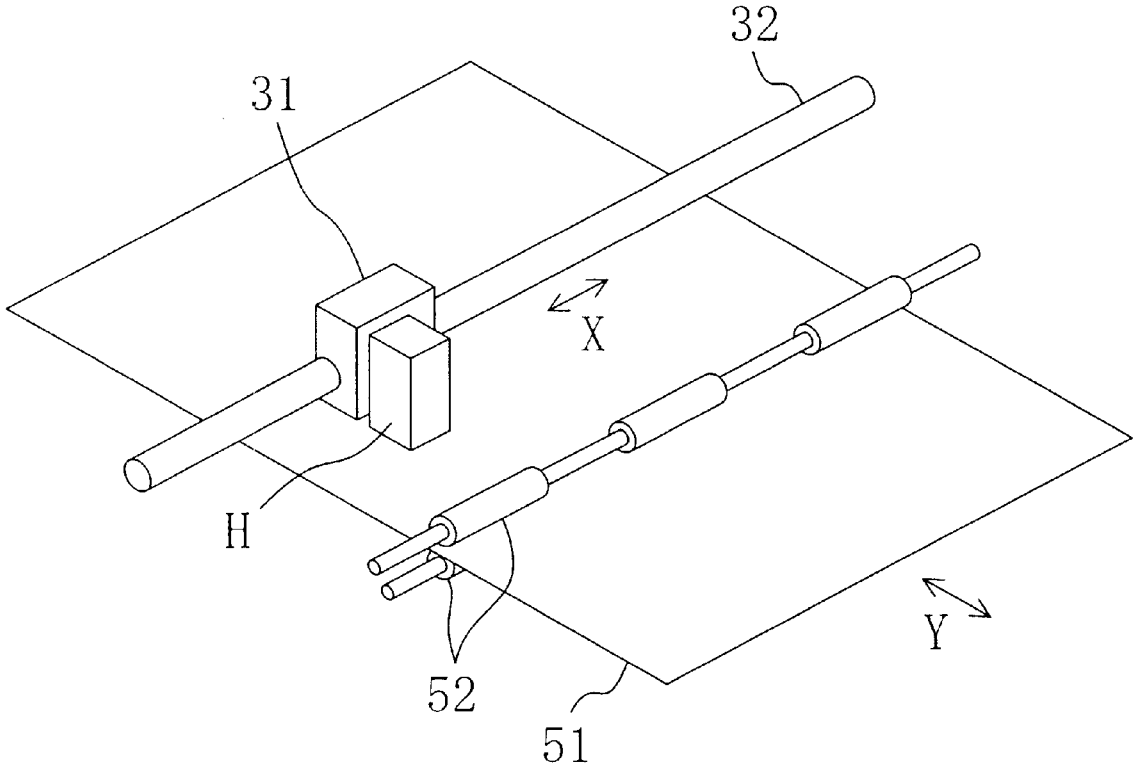
FIG. 1 is a perspective view roughly showing the ink jet recording device of Embodiment 1 of the present invention.

FIG. 1 roughly shows the ink jet recording device of Embodiment 1 of the present invention, which comprises an ink jet head H that directs jets of ink at recording paper 51 as a recording medium in such a manner as will be described below. The ink jet head H is supported by and fixed at a carriage 31 provided with an unillustrated carriage motor, which makes the ink jet head H and carriage 31 reciprocate in the main scanning direction (direction X shown in FIG. 1) while being guided by a carriage axis 32 extending in that direction. The carriage 31, carriage axis 32 and carriage motor compose a relative transfer means which relatively transfers.the ink jet head H and recording paper 51.

The recording paper 51, which is sandwiched between two carriage rollers 52 rotated by an unillustrated carriage motor, is carried in the sub scanning direction (direction Y shown in FIG. 1) perpendicular to the main scanning direction under the ink jet head H by the carriage motor and rollers 52.

Figure 2:
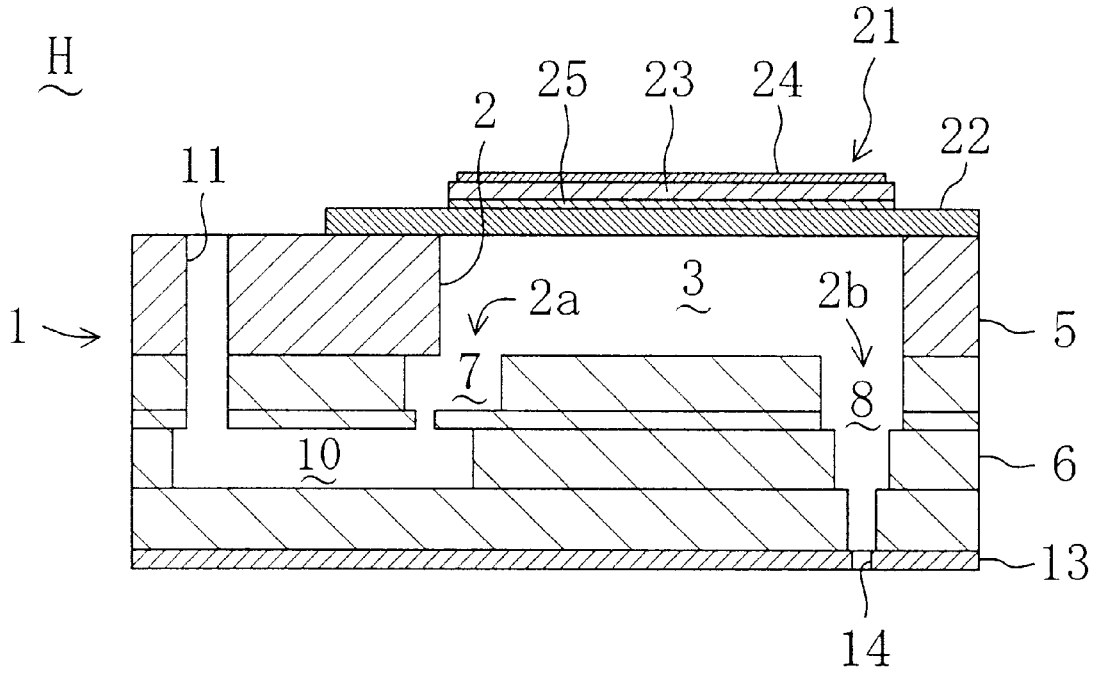
FIG. 2 is a cross sectional view of the ink jet head in the ink jet recording device shown in FIG. 1 when it is taken in the main scanning direction.

As shown in FIG. 2, the ink jet head H comprises a head main body 1 including a plurality of hollows 2 as pressure rooms each having an inlet 2*a* for ink supply and an outlet 2*b* for ink discharge. The hollows 2 of the head main body 1 are opened on the top surface of the head main body 1 so as to be extended in the main scanning direction, and arranged approximately at regular intervals in the sub scanning direction.

The side walls of each of the hollows 2 in the head main body 1 are composed of a pressure room component 5 made from photosensitive glass of about 200 $\mu$m in thickness. The bottom wall of each of the hollows 2 is composed of ink path component 6, which is fixed to the pressure room component 5 and made by bonding a plurality of stainless steel thin plates together. The ink path component 6 has paths 7 for ink supply and paths 8 for ink discharge which are connected with the corresponding inlets 2*a* and outlets 2*b*, respectively. The paths 7 for ink supply are connected with an ink supply room 10 extending in the direction in which the hollows 2 are arranged (in the sub scanning direction), and the ink supply room 10 is connected with an ink supply hole 11, which is formed in the pressure room component 5 and ink path component 6, and is connected with an ink tank outside the drawing.

Provided on the surface (bottom surface) of the ink path component 6 that is opposite to the pressure room component 5 side is a nozzle plate 13 of about 20 $\mu$m in thickness which composes the bottom surface of the ink jet head H and is made from a polymer resin such as polyimide. The nozzle plate 13 is provided with nozzles 14 of about 20 $\mu$m in diameter which are connected with the corresponding outlets 2*b* via the paths 8 for ink discharge. These nozzles 14 are arranged in line in the sub scanning direction.

Provided on the surface (top surface) of the pressure room component 5 in the head main body 1 that is opposite to the ink path component 6 side are piezoelectric actuators 21 which block the hollows 2 of the head main body 1, thereby making up pressure rooms 3 together with the hollows 2. The piezoelectric actuators 21 comprise 1 to 10 $\mu$m-thick piezoelectric elements 23 made from lead zirconate titanate (PZT) and 0.05 to 0.6 $\mu$m-thick top electrodes 24 (first electrodes) which are made from Pt and provided on the surfaces (top surfaces) of the piezoelectric elements 23 that are opposite to the pressure rooms 3 side. In addition, a 1 to 10 $\mu$m-thick bottom electrode 22 (second electrode) made from Cr is provided on the surfaces (bottom surfaces) of the piezoelectric elements 23 that are on the pressure rooms 3 side. The single bottom electrode 22 is shared by all the piezoelectric actuators 21 while being connected to the ground, and also functions as so-called diaphragm.

Figure 3:
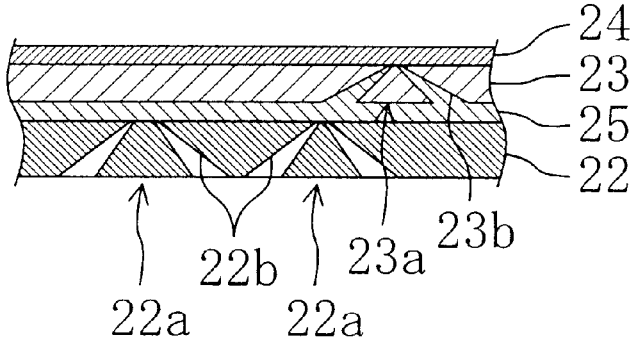
FIG. 3 is an enlarged cross sectional view of the main part of a piezoelectric actuator in the ink jet head shown in FIG. 2.

As shown in a magnified view in FIG. 3, a 0.01 to 0.5 $\mu$m-thick crack covering layer 25 made from an electric insulating material (a crack covering member made from an electric insulating material is formed into a layer) is provided on the surfaces of the piezoelectric elements 23 that are on the bottom electrode 22 side in order to fill the electric insulating material (polyimide, resist, silicon dioxide, alumina, or the like) into cracks 23*b* which are open on both sides of the piezoelectric elements 23 in their thickness direction (penetrating the piezoelectric elements 23 in their thickness direction). As will be described below, the cracks 23*b* in the piezoelectric element 23 are formed around minute defective portions 23*a* which occur while the piezoelectric elements 23 are being formed by spattering in the fabrication of the ink jet head H. The cracks 23*b* are extended and tapered down in the thickness direction of the piezoelectric elements 23 and have approximately circular openings on both sides of the piezoelectric elements 23 in their thickness direction (the inner and outer diameters of the openings are both larger on the bottom electrode 22 side). The bottom electrode 22 has defective portions 22*a* (cracks 22*b*) similar to those in the piezoelectric elements 23; however, the openings of the cracks 22*b* in the bottom electrode 22 that are on the pressure rooms 3 side are open.

Figure 4:
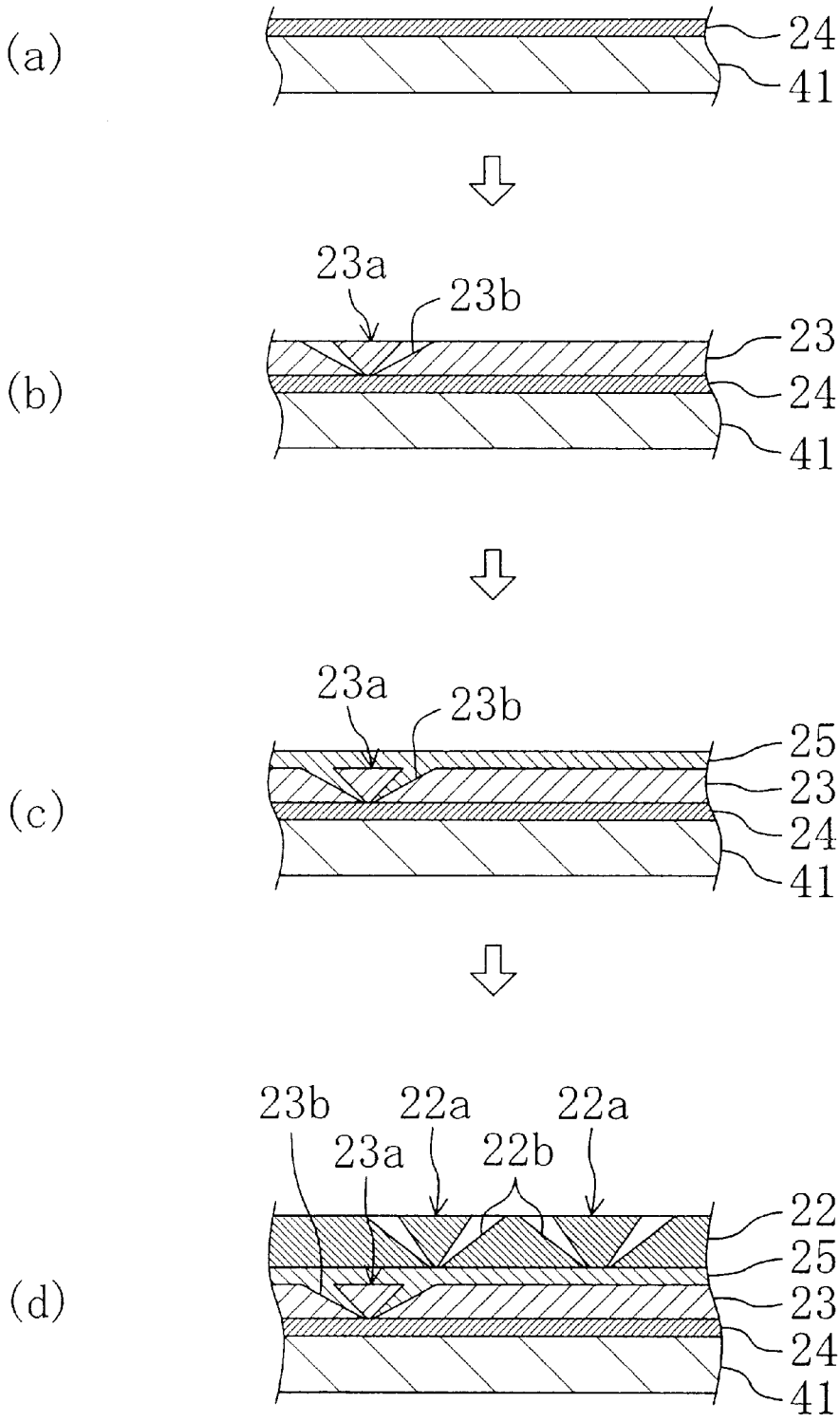
FIG. 4 is rough illustrations showing a method for fabricating the ink jet head shown in FIG. 2.

The rough procedure of a method of fabricating the ink jet head H will be described as follows based on FIG. 4. In FIG. 4, the top and bottom positions of the ink jet head H (piezoelectric actuators 21) are opposite to those in FIGS. 2 and 3.

First, the top electrodes 24 (Pt film) are formed by spattering on the entire surface of a single-crystal MgO substrate 41 of 0.3 mm in thickness (refer to FIG. 4(*a*)), and then the piezoelectric elements 23 (PZT film) are formed by spattering on the entire surfaces of the top electrodes 24 thus formed (refer to FIG. 4(*b*)). During the formation of the piezoelectric elements 23, foreign particles, unevenness in discharge or potential, or other problems cause the cracks 23*b* to develop the detective portions 23*a* isolated from the surrounding regions in the piezoelectric elements 23. Thus, unevenness in discharge or potential in the initial stages of the spattering trigger to cause the defective portions 23*a,* which gradually grow into inverted cones as the film formation proceeds. Consequently, the cracks 23*b* around the defective portions 23*a* are extended and tapered down in the thickness direction of the piezoelectric elements 23 so as to have approximately circular openings on both sides of the piezoelectric elements 23.

Then, the crack covering layer 25 made from an electric insulating material is formed on the entire piezoelectric elements 23, while the electric insulating material is being filled into the cracks 23*b* in the piezoelectric elements 23 (refer to FIG. 4(*c*)). The formation of the crack covering layer 25 is performed by spinning the electric insulating material on the entire piezoelectric elements 23.

Then, the bottom electrode 22 (Cr film) is formed on the entire surface of the crack covering layer 25 thus formed (refer to FIG. 4(*d*)). Although the bottom electrode 22 also has the defective portions 23*a* (cracks 23*b*) similar to those in the piezoelectric element 23, no more layer is formed on the bottom electrode 22 in the present embodiment 1.

Although the illustration is omitted, the bottom electrode 22 thus formed and the head main body 1 prepared in advance are bonded with each other by using an adhesive agent or the like. After this, the substrate 41 is melted and removed (etching removal) by using heat phosphate, KOH, or the like (it is possible to bond only the pressure room component 5 to the bottom electrode 22 before melting and removing the substrate 41, and to bond the ink path component 6 to the nozzle plate 13 after melting and removing the substrate 41). In other words, the bottom electrode 22 is fixed to the pressure room forming member having spaces as pressure rooms. Then, the individual electrodes 24, piezoelectric elements 23, and bottom electrode 22 are shaped as desired by dry etching or another method, and wiring and other necessary processes are done so as to complete the ink jet head H.

The behavior of the ink jet head H will be described as follows. Applying a voltage between the bottom electrode 22 and the top electrodes 24 causes the portions of the piezoelectric actuators 21 that correspond to the pressure rooms 3 to deform in such a manner as to decrease the volume of the pressure rooms 3, so that the ink inside the pressure rooms 3 is discharged through the outlets 2b. To be more specific, applying a pulse-like voltage on the piezoelectric elements 23 via the bottom electrode. 22 and top electrodes 24 causes the piezoelectric elements 23 to contract in the direction perpendicular to their thickness direction due to the electric fields which occur inside the piezoelectric elements 23 (the crack covering layer 25 is thin enough (*0.01* to 0.5 ||m) to generate predetermined electric fields). In contrast, the bottom electrode 22 and top electrodes 24 do not contract, so that the portions of the piezoelectric actuators 21 that correspond to the pressure rooms 3 are deformed so as to bend toward the pressure rooms 3 side due to the so-called bimetal effect. This deformation generates pressure inside the pressure rooms 3, and makes the pressure discharge a predetermined amount of ink in the pressure rooms 3 outside (at the paper to be printed) through the nozzles 14 via the outlets 2*b* and paths 8 for ink discharge, so that the ink adheres onto the paper surface in dots. Instead of using ink of one color, several color inks such as black, cyan, magenta, and yellow can be used and discharged through different nozzles 14 so as to realize color printing.

The application of a driving voltage onto the piezoelectric elements 23 is performed every predetermined time period (50 $\mu$s or so: a drive frequency of 20 kHz, for example) while the ink jet head H and carriage 31 are being transferred nearly at a fixed rate from one end to the other of the recording paper 51 in the main scanning direction (no voltage is applied when the ink jet, head H reaches a point on the recording paper 51 at which no jet of ink is supposed to be directed). As a result, jets of ink are directed at predetermined positions on the recording paper 51. When recording for one scanning is done, the carriage motor and carriage rollers 52 carry the recording paper 51 by a predetermined distance in the sub scanning direction. Then, recording for another scanning is done by discharging ink while transferring the ink jet head H and carriage 31 in the main scanning direction. By repeating these operations, a desired image is formed on the entire surface of the recording paper 51.

When a voltage is placed between the bottom electrode 22 and top electrodes 24 as mentioned above, the electric insulating material filled in the cracks 23*b* around the defective portions 23*a* in the piezoelectric elements 23 prevents the occurrence of leaks in the cracks 23*b* and also maintains the mechanical strength of the piezoelectric elements 23. When the piezoelectric actuators 21 are deformed, the ink inside the pressure rooms 3 intrudes into the cracks 22*b* in the bottom electrode 22 through their openings on the pressure rooms 3 side (the ink may intrude even when the piezoelectric actuators 21 are in the stationary state). Even if the ink intrudes into the cracks 22*b,* the crack covering layer 25 blocks the piezoelectric elements 23 against the ink, and also prevents the ink from intruding into the cracks 23*a* in the piezoelectric elements 23. Consequently, no short occurs between the bottom electrode 22 and top electrodes 24 even if the ink has lower electric insulation than the piezoelectric elements 23. In other words, the crack covering layer 25 also functions as ink contact prevention layer (an ink contact prevention member formed as a layer on the surfaces of the piezoelectric elements 23 that are on the bottom electrode 22 side) which keep the ink inside the pressure rooms 3 from contact with the piezoelectric elements 23 via the cracks 22*b* penetrating the bottom electrode 22 in its thickness direction.

Thus, in the present embodiment 1, the provision of the crack covering layer 25 on the surfaces of the piezoelectric elements 23 that are on the bottom electrode 22 side prevents the piezoelectric actuators 21 from malfunctioning even if the bottom electrode 22 and piezoelectric elements 23 have the cracks 22*b* and 23*b* due to the defective portions 22*a* and 23*a,* respectively. Consequently, satisfying ink discharge performance can be maintained for a long period of time. This feature achieves the downsizing of an ink jet head H by making the piezoelectric elements 23 and other elements into thin films, while increasing their durability.

Figure 5:
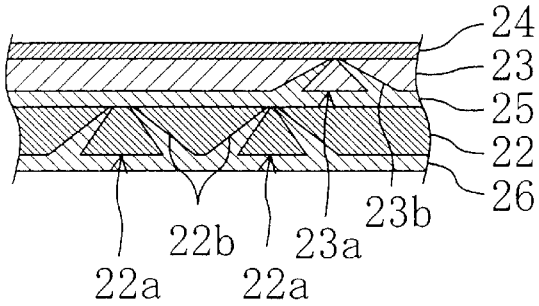
FIG. 5 is a modified example of Embodiment 1 corresponding to FIG. 3.

In the present embodiment 1, no layer is provided on the surface of the bottom electrode 22 that is on the pressure rooms 3 side; however, as shown in FIG. 5, it is possible to provide an ink contact prevention layer 26 (an ink contact prevention member formed as a layer) which keeps the ink inside the pressure rooms 3 from contact with the piezoelectric elements 23 via the cracks 22*b* in the bottom electrode 22 (the process of forming the ink contact prevention layer 26 on the entire surface of the bottom electrode 22 is added after the formation of the bottom electrode 22 and before the fixing of the head main body 1, and the ink contact prevention layer 26 is fixed to the head main body 1). By doing so, the ink contact prevention layer 26 can be much thicker than the crack covering layer 25 formed on the surfaces of the piezoelectric elements 23 on the bottom electrode 22 side, thereby further securing the protection of the piezoelectric elements 23 against the ink. The ink contact prevention layer 26 can be either made from the same electric insulating material as the crack covering layer 25 or from a conductive material (titanium, nickel, a nickel-chrome alloy, tantalum, molybdenum, stainless steel, or the like) (the layer 26 is formed by spinning the electric insulating material, or by spattering or depositing the conductive material). It is unnecessary to fill either the electric insulating material or conductive material into the cracks 22*b* in the bottom electrode 22 completely; the openings of the cracks 22*b* on the pressure rooms 3 side can be sealed exclusively. However, it is preferable to make the ink contact prevention layer 26 from a conductive material and to fill the conductive material into the cracks 22*b* in the bottom electrode 22. This is because the mechanical strength of the bottom electrode 22 can be maintained and electric fields can be generated nearly uniformly on the entire piezoelectric elements 23. Furthermore, it is not necessary to form the ink contact prevention layer 26 as a layer; it could be formed to block each of the openings of the cracks 22*b* on the pressure rooms 3 side.

In the present embodiment 1, provided that there is no occurrence of the defective portions 23*a* (cracks. 23*b*) on the portions of the piezoelectric elements 23 (between the electrodes 22 and 24) that correspond to the top electrodes 24 (finished by dry etching or the like), instead of providing the crack covering layer 25 (which also functions as an ink contact prevention layer) made from an electric insulating material on the surfaces of the piezoelectric elements 23 that are on the bottom electrode 22 side, an ink contact prevention layer can be provided which is made from a conductive material (titanium, nickel, a nickel-chrome alloy, tantalum, molybdenum, stainless steel, or the like) and which keeps the piezoelectric elements 23 from contact with the ink inside the pressure rooms 3 via the cracks 22*b* in the bottom electrode 22. By doing so, it becomes possible not only to keep the ink inside the pressure rooms 3 from contact with the piezoelectric elements 23 thereby protecting the elements 23 against the ink, but also to generate electric fields nearly uniformly and properly on the entire piezoelectric elements 23, regardless of the thickness of the ink contact prevention layer.

The crack covering layer 25 formed by making a crack covering member into a layer is provided on the surfaces of the piezoelectric elements 23 on the bottom electrode 22 side in the present embodiment 1. However, the crack covering member does not need to be formed as a layer; it can have any shape as long as an electric insulating material is filled into each of the cracks 23*b*. In any case, the mechanical strength of the piezoelectric elements 23 can be maintained and the occurrence of leaks in the cracks 23*b* can be prevented, thereby increasing the durability of the piezoelectric actuators 21. It must be noted that if the crack covering member is also used as an ink contact prevention member, it need to be formed as a layer.

Embodiment 2

Figure 6:
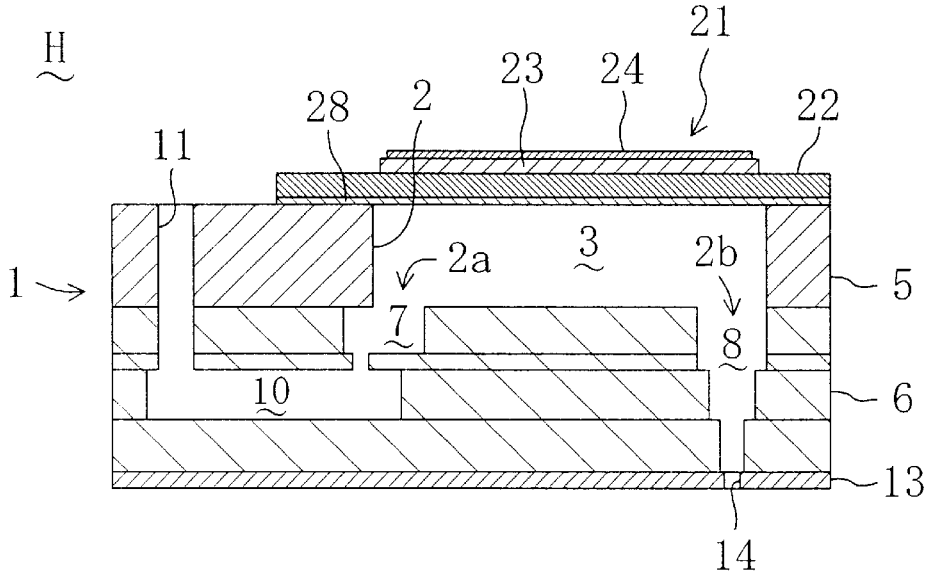
FIG. 6 is a view of Embodiment 2 corresponding to FIG. 2.
Figure 7:
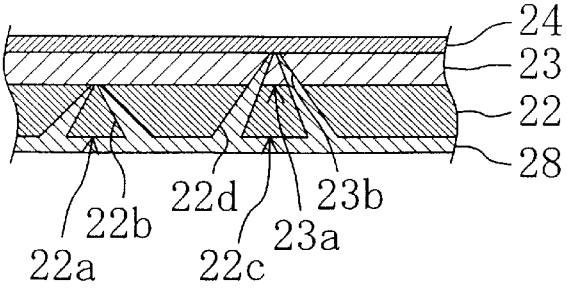
FIG. 7 is an enlarged cross sectional view of the main part of one of the piezoelectric actuators in the ink jet head shown in FIG. 6.

FIGS. 6 and 7 show Embodiment 2 of the present invention (the same components as those in FIGS. 2 and 3 are referred to with the same reference numbers and their detailed description will be omitted) where a crack covering layer 28 is provided on the surface of the bottom electrode 22 in the piezoelectric actuators 21 that is on the pressure rooms 3 side.

Thus, the present embodiment 2 does not include the crack covering layer 25 shown in Embodiment 1 provided on the surfaces. of the piezoelectric elements 23 which are on the bottom electrode 22 side; the bottom electrode 22 and piezoelectric elements 23 are accumulated in immediate contact with each other. The bottom electrode 22 has, in addition to the detective portions 22*a* shown in Embodiment 1, defective portions 22*c* which are contiguous with the defective portions 23*a* in the piezoelectric elements 23, so that the cracks 22*d* and 23*b* around the defective portions 22*c* and 23*a* contiguous with each other are also formed to be contiguous with each other. The crack covering layer 28 made from an electric insulating material is provided (a crack covering member made from an electric insulation material is formed as a layer) on the surface of the bottom electrode 22 that is on the pressure rooms 3 side, so as to fill the electric insulating material (polyimide, resist, silicon dioxide, alumina, or the like) into the cracks 22*d* and 23*b*. The crack covering layer 28 and head main body 1 are fixed to each other. In the bottom electrode 22, the electric insulating material used for the crack covering layer 28 is filled into the separate cracks 22*b* which are not contiguous with the detective portions 23*a* in the piezoelectric elements 23.

The procedure of a method for fabricating the ink jet head H will be roughly described based on FIG. 8 as follows. First, similar to Embodiment 1, the top electrodes 24 (Pt film) are formed by spattering on the entire surface of the substrate 41 (refer to FIG. 8(*a*)), and then the piezoelectric elements 23 (PZT film) are formed by spattering on the entire surface of the top electrode 24 thus formed (refer to FIG. 8(*b*)). At this moment, the piezoelectric elements 23 have the defective portions 23*a* (cracks 23*b*) similar to those in Embodiment 1.

Figure 8:
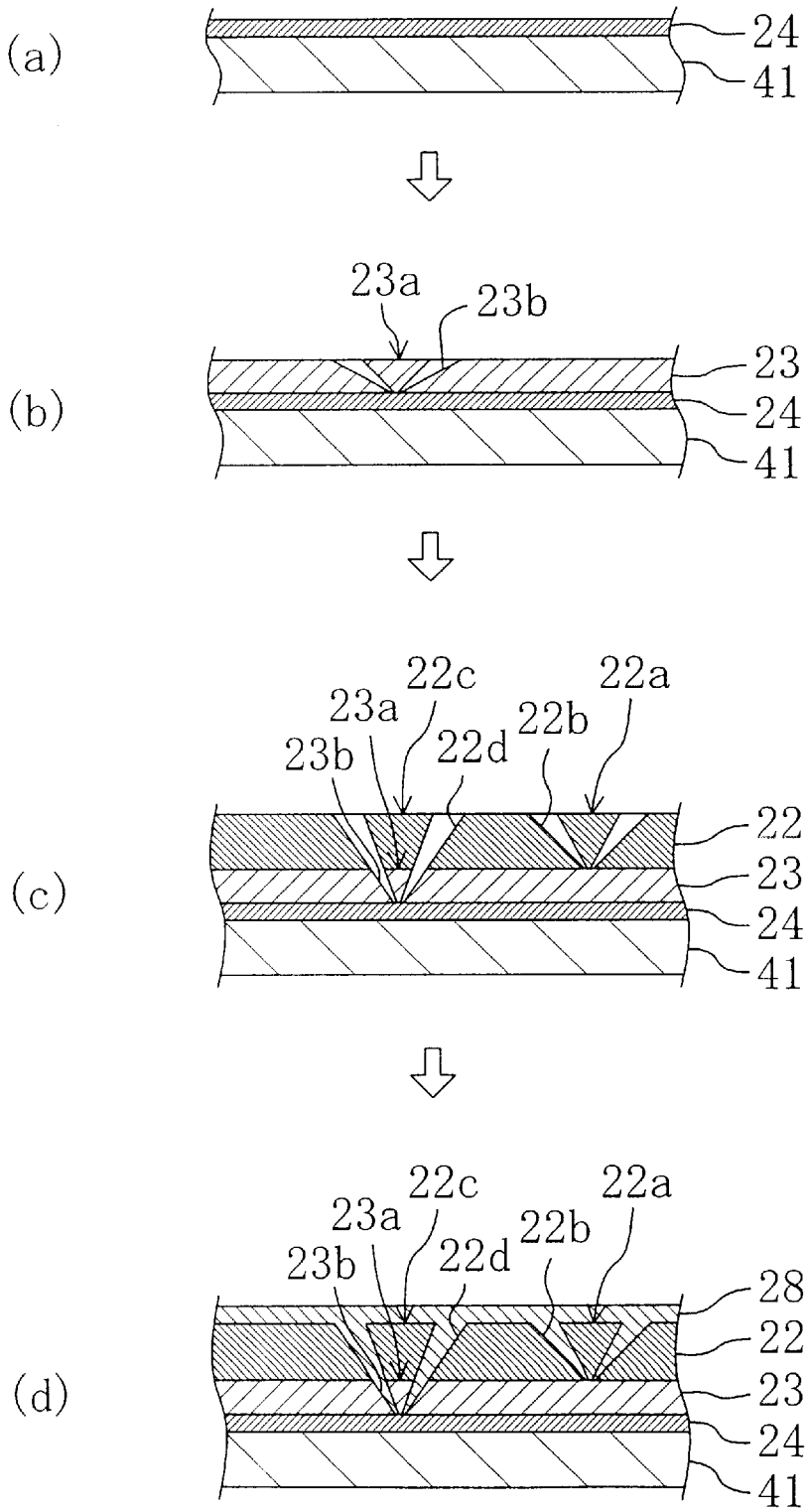
FIG. 8 is rough illustrations showing a method for fabricating the ink jet head shown in FIG. 6.
Figure 9:
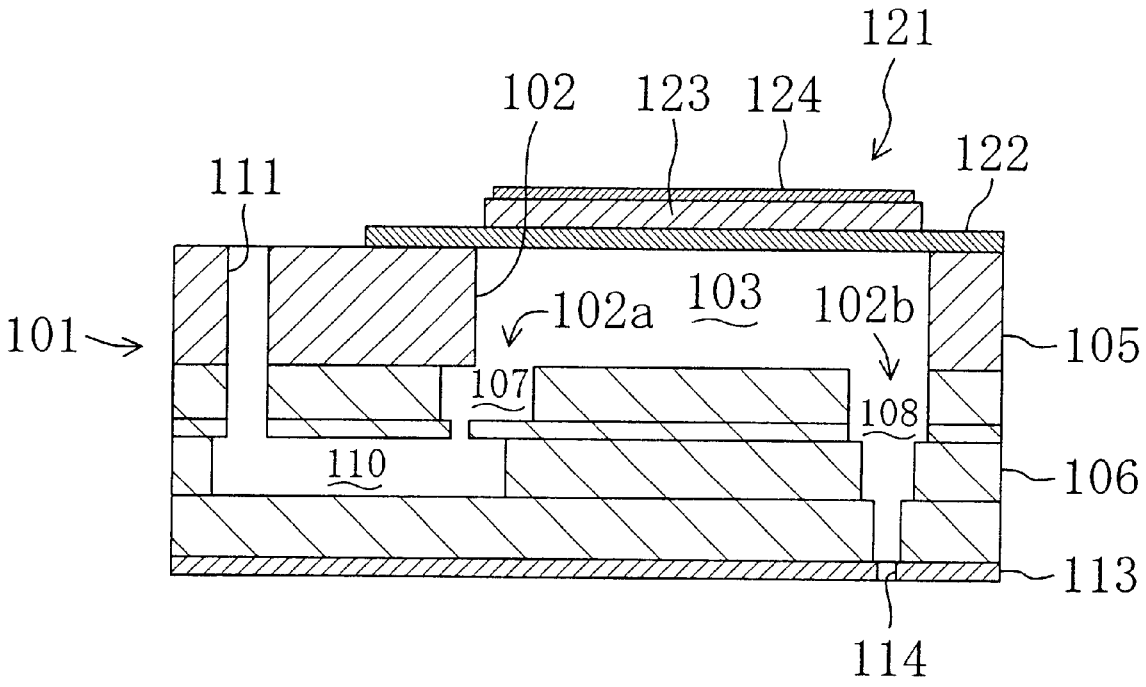
FIG. 9 is a cross sectional view of a prior art ink jet head.

Then, the bottom electrode 22 (Cr film) is formed by spattering on the entire piezoelectric elements 23 (refer to FIG. 8(*c*)). At this moment, the defective portions 22*c* in the bottom electrode 22 are caused by the defective portions 23*a* in the piezoelectric elements 23 in such a manner as to be contiguous with the portions 23*a* and outgrow them. The bottom electrode 22 also has separate defective portions 22*a* (cracks 22*b*) which are similar to the defective portions 23*a* in the piezoelectric elements 23 and which are not contiguous with the defective portions 23*a* in the piezoelectric elements 23.

Then, while filling the electric insulating material into the cracks 22*d,* 23*b* contiguous with each other, and separate cracks 22*b,* the crack covering layer 28 made from the electric insulating material is formed on the entire surface of the bottom electrode 22 (FIG. 8(*d*)). The formation of the crack covering layer 28 is performed by spinning the electric insulating material on the entire surfaces of the piezoelectric elements 23 in the same manner as the crack covering layer 25 of Embodiment 1.

Although the illustration is omitted, in the same manner as in Embodiment 1, the crack covering layer 28 and head main body 1 (only the pressure room component 5 will do) prepared in advance are fixed to each other. Later, the substrate 41 is melted and removed (etching removal). The separate electrodes 24, piezoelectric elements 23, and bottom electrode 22 are shaped as desired by dry etching or another method, and wiring and other necessary processes are done so as to complete the ink jet head H.

Thus, in the present embodiment 2, the electric insulating material filled into the cracks 22*d* and 23*b* contiguous with each other, and separate cracks 22*b* in the bottom electrode 22 and piezoelectric elements 23 can prevent the occurrence of leaks in the cracks 23*b* in the piezoelectric elements 23 and also maintain the mechanical strength of the bottom electrode 22 and piezoelectric elements 23 in the same manner as in Embodiment 1. Furthermore, the piezoelectric elements 23 can be protected against intrusion by the ink, which indicates that the crack covering layer 28 also functions as an ink contact prevention layer that keeps the ink inside the pressure rooms 3 from contact with the piezoelectric elements 23 via the cracks 22*b* penetrating the bottom electrode 22 in its thickness direction.

In the present embodiment 2, provided that there is no occurrence of the defective portions 23*a* (cracks 23*b*) in the portions of the piezoelectric elements 23 (between the electrodes 22 and 24) that correspond to the top electrodes 24 (finished by dry etching or the like), instead of providing the crack covering layer 28 (which also functions as an ink contact prevention layer) made from an electric insulating material, an ink contact prevention layer (same as the ink contact prevention layer 26 shown in FIG. 5) made from a conductive material can be provided on the surface of the bottom electrode 22 that is on the piezoelectric elements 23 side. By doing so, it becomes possible not only to prevent the piezoelectric elements 23 from being in contact with the ink inside the pressure rooms 3, but also to generate electric fields nearly uniformly on the entire piezoelectric elements 23 by filling the conductive material into the cracks 22*b* in the bottom electrode 22.

In the present embodiment 2, the crack covering layer 28 formed by making the crack covering member into a layer is provided on the surface of the bottom electrode 22 that is on the piezoelectric elements 23 side. However, similar to Embodiment 1, the crack covering member can have any shape as long as the electric insulating material can be filled into each of the cracks 22*d,* 23*b* contiguous with each other, and separate cracks 22*b.*

The bottom electrode 22 and piezoelectric elements 23, which are formed by spattering in Embodiments 1 and 2, may be formed by deposition instead. In this case, the cracks 22*b,* 22*d,* and 23*b* are caused by the defective portions 22*a,* 22*c,* and 23*a* similar to those in Embodiments 1 and 2, so that the effects of the present invention can be exerted effectively.

The cracks 23*b* in the piezoelectric elements 23 can be of any shape in order to fill an electric insulating material thereinto, even if they are not caused by the defective portions 23*a* as in Embodiments 1, 2 as long as they are open at least on the surface of the piezoelectric elements 23 that is on the bottom electrode 22 side. To be more specific, the cracks 23*b,* which would easily cause leaks if they were hollow inside, can be filled with an electric insulating material so as to maintain the voltage resistance of the piezoelectric elements 23, thereby preventing the production of a dielectric breakdown. On the other hand, the cracks 22*b* and 22*d* in the bottom electrode 22 can be of any shape in order to fill an electric insulating material thereinto, provided that they penetrate the bottom electrode 22 in its thickness direction and make the ink in the pressure rooms 3 intrude toward the piezoelectric elements 23.

In addition, various other modifications are possible about the components of the ink jet head; for example, the bottom electrode 22, piezoelectric elements 23, top electrodes 24, and other components of the piezoelectric actuators 21 can be made from different materials and have different degrees of thickness from the corresponding components in Embodiments 1 and 2 (the bottom electrode 22 can be made of either titanium, nickel, a nickel-chrome or the like, for example). The bottom electrode 22 does not need to be used as a diaphragm, and can be composed of two layers of an electrode layer and a diaphragm layer. Furthermore, the pressure room component 5, ink path component 6, and nozzle plate 13 contained in the head main body 1 can be made from different materials and have different degrees of thickness from the corresponding components in Embodiments 1 and 2.

Industrial Applicability

The present invention is useful when used in printers for computers, facsimiles, copy machines and other such devices. The present invention has a high industrial applicability because the formation of the piezoelectric elements, electrodes, and other components of the piezoelectric actuators into thin films achieves downsizing of the ink jet head, while the piezoelectric actuators are prevented from malfunctioning due to the cracks which occur in the piezoelectric elements or electrodes during the film formation so as to increase the durability of the piezoelectric actuators.

What is claimed is:

1. An ink jet head comprising:

a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet, wherein a crack covering member made from an electric insulating material is arranged on a surface of said piezoelectric actuator that is on a second electrode side in such a manner as to fill said electric insulating material into a crack which is open on a surface of the piezoelectric element that is on the second electrode side.

2. The ink jet head of claim 1, wherein said crack covering member is formed as a layer on the surface of the piezoelectric element that is on the second electrode side.

3. An ink jet head comprising:

a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet, wherein a crack covering member made from an electric insulating material is provided on a surface of the second electrode of said piezoelectric actuator that is on the pressure room side in such a manner as to fill said electric insulating material into a crack which is open on the surface of the second electrode that is on the pressure room side and which is contiguous across the second electrode and piezoelectric element.

4. The ink jet head of claim 3, wherein said crack covering member is formed as a layer on the surface of the second electrode that is on the pressure room side.

5. An ink jet head comprising:

a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet, wherein an ink contact prevention member is formed as a layer on the surface of the of said piezoelectric actuator that is on the second electrode side so as to prevent the piezoelectric element from being in contact with the ink inside the pressure room via a crack penetrating the second electrode in a thickness direction thereof.

6. An ink jet head comprising:

a head main body including a hollow as a pressure room having an inlet for ink supply and an outlet for ink discharge, and a nozzle leading to the outlet; and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet, wherein an ink contact prevention member is formed on the surface of a second electrode of said piezoelectric actuator that is on the pressure room side so as to prevent the piezoelectric element from being in contact with the ink inside the pressure room via a crack penetrating the second electrode in a thickness direction thereof.

7. The ink jet head of claim 6, wherein said ink contact prevention member is formed as a layer on the surface of the second electrode that is on the pressure room side.

8. A method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and the second electrode, said method comprising the steps of:

forming the first electrode on a substrate;

forming the piezoelectric element on the first electrode;

forming a crack covering layer made from an electric insulating material on the piezoelectric element while filling said electric insulating material into a crack which is open on a top surface of the piezoelectric element;

forming the second electrode on said crack covering layer;

fixing the second electrode to a pressure room forming member having a space for the pressure room; and removing the substrate after said fixing step.

9. A method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and the second electrode, said method comprising the steps of:

forming the first electrode on a substrate;

forming the piezoelectric element on the first electrode;

forming the second electrode on the piezoelectric element;

forming a crack covering layer made from an electric insulating material on the second electrode, while filling said electric insulating material into a crack which is open on a top surface of the second electrode and which is contiguous across the second electrode and the piezoelectric element;

fixing said crack covering layer to a pressure room forming member having a space for the pressure room; and removing the substrate after said fixing step.

10. A method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and the second electrode, said method comprising the steps of:

forming the first electrode on a substrate;

forming the piezoelectric element on the first electrode;

forming an ink contact prevention layer on the piezoelectric element;

forming the second electrode on said ink contact prevention layer;

fixing the second electrode to a pressure room forming member having a space for the pressure room; and removing the substrate after said fixing step, wherein said ink contact prevention layer prevents the ink contained in the pressure room from being in contact with the piezoelectric element via a crack penetrating the second electrode in a thickness direction thereof.

11. A method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and the second electrode, said method comprising the steps of:

forming the first electrode on a substrate;

forming the piezoelectric element on the first electrode;

forming the second electrode on the piezoelectric element;

forming an ink contact prevention layer on the second electrode;

fixing said ink contact prevention layer to a pressure room forming member having a space for the pressure room; and removing the substrate after said fixing step, wherein said ink contact prevention layer prevents the ink contained in the pressure room from being in contact with the piezoelectric element via a crack penetrating the second electrode in a thickness direction thereof.

12. A method for fabricating an ink jet head comprising a pressure room which contains ink, a nozzle leading to the pressure room, a first electrode arranged on one side and a second electrode arranged on other side of a piezoelectric element in a thickness direction thereof, and a piezoelectric actuator which discharges the ink contained in the pressure room through the nozzle by applying a voltage onto the piezoelectric element via the first electrode and the second electrode, said method comprising the steps of:

forming the first electrode on a substrate;

forming the piezoelectric element on the first electrode;

forming a crack covering layer made from an electric insulating material on the piezoelectric element, while filling said electric insulating material into a crack occurring in the piezoelectric element in such a manner as to be open on a top surface of the piezoelectric element;

forming the second electrode on the piezoelectric element;

forming an ink contact prevention layer on the second electrode;

fixing said ink contact prevention layer to a pressure room forming member having a space for the pressure room; and removing the substrate after said fixing step, wherein said ink contact prevention layer prevents the ink contained in the pressure room from being in contact with the piezoelectric element via a crack penetrating the second electrode in a thickness direction thereof.

13. An ink jet recording device comprising:

an ink jet head composed of a head main body including a hollow as a pressure room having an inlet for ink supply and an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet; and relative transfer means for transferring said ink jet head and a recording medium relatively, wherein recording is performed by directing jets of the ink at the recording medium through the nozzle of the head main body of said ink jet head, while said ink jet head is being transferred relatively to the recording medium by said relative transfer means, and said ink jet recording device further comprises a crack covering member made from an electric insulating material and arranged on a surface of the of said piezoelectric actuator of said ink jet head that is on the second electrode side in such a manner as to fill said electric insulating material into a crack which is open on the surface of the piezoelectric element that is on the second electrode side.

14. An ink jet recording device comprising:

an ink jet head composed of a head main body including a hollow as a pressure room having an inlet for ink supply nd an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet; and relative transfer means for transferring said ink jet head and a recording medium relatively, wherein recording is performed by directing jets of the ink at the recording medium through the nozzle of the head main body of said ink jet head, while said ink jet head is being transferred relatively to the recording medium by said relative transfer means, and said ink jet recording device further comprises a crack covering member made from an electric insulating material and arranged on a surface of the second electrode of said piezoelectric actuator of said ink jet head that is on the pressure room side in such a manner as to fill said electric insulating material into a crack which is open on the surface of the second electrode that is on the pressure room side and which is contiguous across the second electrode.

15. An ink jet recording device comprising:

an ink jet head composed of a head main body including a hollow as a pressure room having an inlet for ink supply and an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet; and relative transfer means for transferring said ink jet head and a recording medium relatively, wherein recording is performed by directing jets of the ink at the recording medium through the nozzle of the head main body of said ink jet head, while said ink jet head is being transferred relatively to the recording medium by said relative transfer means, and said ink jet recording device further comprises a crack covering member made from an electric insulating material and arranged as a layer on a surface of said piezoelectric actuator of said ink jet head that is on a second electrode side so as to prevent the ink contained in the pressure room from being in contact with the piezoelectric element via a crack penetrating the second electrode in a thickness direction thereof.

16. An ink jet recording device comprising:

an ink jet head composed of a head main body including a hollow as a pressure room having an inlet for ink supply and an outlet for ink discharge, and a nozzle leading to the outlet, and a piezoelectric actuator which is arranged to block said hollow and make up the pressure room together with said hollow and which includes a piezoelectric element, a first electrode arranged on a surface of the piezoelectric element that is opposite to a pressure room side, and a second electrode arranged on other surface of the piezoelectric element that is on the pressure room side, said piezoelectric actuator making the pressure room deform to decrease its capacity by applying a voltage onto the piezoelectric element via the first electrode and the second electrode, thereby discharging ink contained inside the pressure room through the outlet; and relative transfer means for transferring said ink jet head and a recording medium relatively, wherein recording is performed by directing jets of the ink at the recording medium through the nozzle of the head main body of said ink jet head, while said ink jet head is being transferred relatively to the recording medium by said relative transfer means, and said ink jet recording device further comprises an ink contact prevention member arranged on a surface of the second electrode of said piezoelectric actuator of said ink jet head that is on the pressure room side so as to prevent the ink contained in the pressure room from being in contact with the piezoelectric element via a crack penetrating the second electrode in a thickness direction thereof.

* * * * *

UNITED STATES PATENT AND TRADEMARK OFFICE

CERTIFICATE OF CORRECTION

PATENT NO. : 6,467,886 B1
DATED : October 22, 2002
INVENTOR(S) : Shigeyuki Takao et al.

It is certified that error appears in the above-identified patent and that said Letters Patent is hereby corrected as shown below:

Title page, Item [54] and Column 1, lines 1-3,
Title, "INK-JET HEAD, METHOD FOR FABRICATING SAME, AND INK-JET RECORDING DEVICE" should be -- INK JET HEAD, METHOD FOR FABRICATING THE SAME, AND INK JET RECORDING DEVICE --.

Title page,
Item [87], PCT Pub. Date: "Sep. 13, 2000" should be -- March 22, 2001 --.
Item [57], ABSTRACT,
Line 2, "provided the" should be -- provided on the --.
Line 3, "to pressure" should be -- to the pressure --.
Line 4, "3" should be -- 3 side --.
Line 4, "on other" should be -- on the other --.
Line 5, "3 into" should be -- 3 side into --.
Line 6, "in piezoelectric" should be -- in the piezoelectric --.
Line 6, "a crack" should be -- the crack --.
Line 7, "layer 28" should be -- layer 25 --.
Line 9, "22 so" should be -- 22 side so --.

Column 17,
Line 45, "of the of said" should be -- of said --.

Column 20,
Line 24, "of the of said" should be -- of said --.
Line 34, "nd" should be -- and --.
Line 63, "electrode" should be -- electrode and the piezoelectric element --.

Signed and Sealed this

Twenty-ninth Day of July, 2003

JAMES E. ROGAN
*Director of the United States Patent and Trademark Office*